US007302068B2

(12) United States Patent
Longbottom et al.

(10) Patent No.: US 7,302,068 B2
(45) Date of Patent: Nov. 27, 2007

(54) LOUDSPEAKER

(75) Inventors: Simon Andrew Longbottom, Cambridge (GB); Andrew Matheson, Belmont, MA (US); Gareth McKevitt, Cambridge (GB); Richard Topliss, Cambridge (GB); Matthew John Pitts, Cambridge (GB); Mark Richard Shepherd, Hertfordshire (GB)

(73) Assignee: 1 . . .Limited, Cambridge (GB)

( * ) Notice: Subject to any disclaimer, the term of this patent is extended or adjusted under 35 U.S.C. 154(b) by 458 days.

(21) Appl. No.: 10/480,733

(22) PCT Filed: Jun. 19, 2002

(86) PCT No.: PCT/GB02/02836

§ 371 (c)(1),
(2), (4) Date: May 28, 2004

(87) PCT Pub. No.: WO03/001841

PCT Pub. Date: Jan. 3, 2003

(65) Prior Publication Data

US 2004/0202338 A1 Oct. 14, 2004

(30) Foreign Application Priority Data

| | | | |
|---|---|---|---|
| Jun. 21, 2001 | (GB) | ..... | 0115244.6 |
| Sep. 21, 2001 | (GB) | ..... | 0122800.6 |
| Mar. 12, 2002 | (GB) | ..... | 0205750.3 |

(51) Int. Cl.
*H04R 25/00* (2006.01)

(52) U.S. Cl. ..... 381/162; 381/152

(58) Field of Classification Search ..... 381/152, 381/161–167, 173, 190, 431; 310/27, 154, 310/264
See application file for complete search history.

(56) References Cited

U.S. PATENT DOCUMENTS

| | | | | |
|---|---|---|---|---|
| 3,900,748 | A | 8/1975 | Alder | |
| 4,564,727 | A * | 1/1986 | Danley et al. | 381/162 |
| 5,802,189 | A * | 9/1998 | Blodget | 381/162 |
| 6,078,126 | A | 6/2000 | Rollins et al. | |
| 6,985,596 | B2 * | 1/2006 | Bank et al. | 381/152 |
| 2002/0067841 | A1 | 6/2002 | Bank et al. | |

FOREIGN PATENT DOCUMENTS

| | | |
|---|---|---|
| FR | 2649575 | 1/1991 |
| JP | 54-075126 | 5/1979 |
| JP | 54-167701 | 11/1979 |
| JP | 02-021896 | 2/1990 |
| WO | WO 97/09842 | 3/1997 |
| WO | WO 00/02417 | 1/2000 |
| WO | 00/13464 | 3/2000 |
| WO | WO 0147041 A | 6/2001 |
| WO | WO 0147318 A2 | 6/2001 |

* cited by examiner

*Primary Examiner*—Suhan Ni
(74) *Attorney, Agent, or Firm*—Elman Technology Law, P.C.; Gerry J. Elman

(57) ABSTRACT

A loudspeaker for audible sound is described having a sound emitting element mounted onto a support structure and at least one actuator adapted to rotate said sound emitting element around a hinge section, wherein the actuator is made of piezoelectric material. In variants the actuator forms part of the hinge section and the loudspeaker is capable of generating vibrations through its support structure.

6 Claims, 11 Drawing Sheets

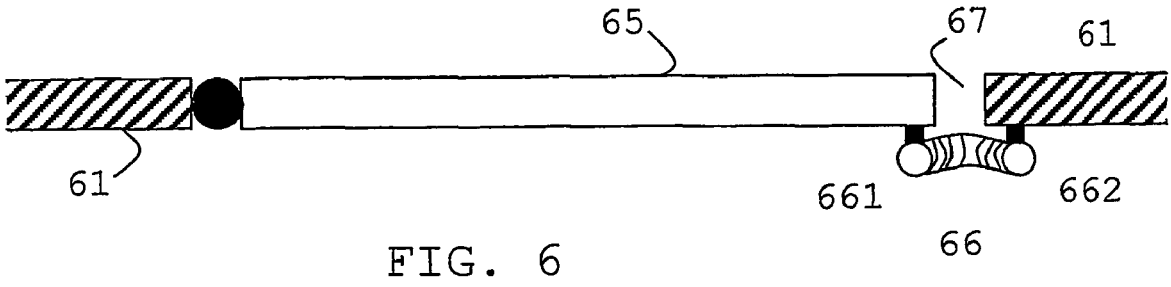
FIG. 6
FIG. 7A
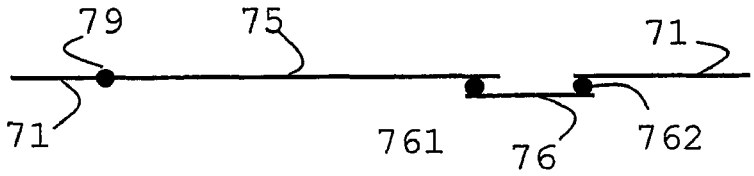
FIG. 7B
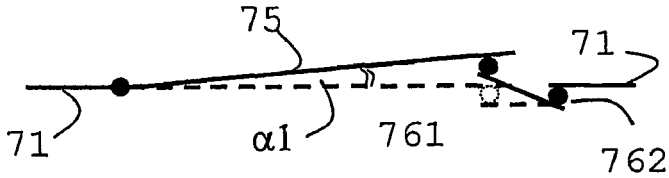
FIG. 7C
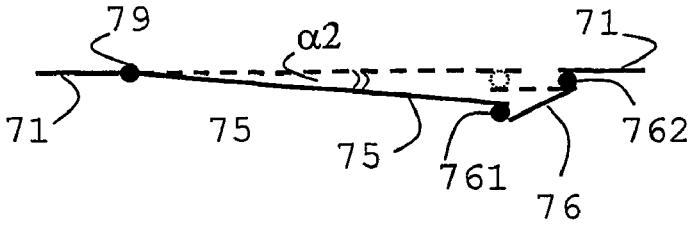

Hz

LOUDSPEAKER

FIELD OF THE INVENTION

The present invention relates to loudspeaker systems for portable electronic devices such as mobile phones, personal digital assistants (PDAs) and laptop computers. More specifically, it relates to a method and system for generating low frequency or vibratory signals and higher acoustic frequency or audible signals. Furthermore it relates to such systems driven by actuators based on piezoelectric materials.

BACKGROUND OF THE INVENTION

In mobile communication and data processing equipment, the generation of audible sound, buzz tones or vibration are handled by systems mostly driven by electromagnetic actuators.

Sound is usually generated by, albeit small, voice-coil driven loudspeakers, whereas number of reasonably inexpensive and effective constructions have evolved for providing signal units to generate the necessary tones or vibrations for these devices. These include miniature motors with imbalanced rotors to create a sensible vibration; small piezoelectric assemblies to vibrate at an audio frequency and create a tone or beep ("buzz") noise; and other, older technologies such as speakers with an electromagnetic voice coil, or a magnetic solenoid driving a diaphragm or other sound emitting element to create a sound such as an audio tone or a vibratory buzz. Many of the current mobile phones use separate components for vibration alert, audio alert and speech or music reproduction.

Also, it is desirable for most portable devices to a have a "hands-free" mode, i.e., a mode that allows a user to communicate through the device without having to use his or her hands. In order to operate portable phones in a hands-free mode, a high power output is required over a frequency range of 300 to 3400 Hz, often referred to as the speech band. At present the hands-free mode of commercially available products is exclusively implemented through common electro-dynamic or moving coil loudspeakers.

In a preprint of the Audio Engineering Society (AES) for the AES 108$^{th}$ Convention, Paris, 2000 Feb. 19-22, Preprint No. 5160, A. Bright et al. describe in details the problems surrounding any attempt to use a single component to perform vibration alert, audio alert and speech or music reproduction. The authors suggest such devices based on the common electro-dynamic loudspeaker or voice coil system.

A number of piezoelectric alerting devices have been proposed to generate a vibration or non-audible alert or audio frequency vibration and, thus, constituting a speaker. Examples of such devices are described in the U.S. Pat. Nos. 5,514,927; 5,368,456; 6,078,126 and 6,169,206.

In view of the above, it is the purpose of the present invention to provide a loudspeaker for electronic devices, particularly portable electronic devices such as mobile phones, which is compact, lightweight, provides sufficient sound for hands-free operation but does not present a sound hazard to the listener if held close to the ear. It is a further object of the invention to provide a space- and energy-efficient device and method for generating a tactile or vibratory alarm and audible sound.

SUMMARY OF THE INVENTION

Accordingly, in a first aspect the present invention provides a loudspeaker for a possibly portable electronic device such as a mobile phone which comprises a support on which is mounted an electro-active actuator, which is in turn coupled to an area-extensive section of the case of the device, which section of the case acts as the sound generating element of the loudspeaker.

The loudspeaker of the invention has several advantages. Firstly, the sound generating element (e.g. diaphragm) of the loudspeaker may be as large a section of the case as desired, providing a large area for radiating sound. This allows a high Sound Pressure Level (SPL) to be produced at low frequencies. Secondly, the area of the sound generating element is considerably larger than the area of the opening of the ear canal, that is, more than about 1 cm across, such that when the loudspeaker is held close to the ear the energy density is not high enough to cause a hazard to the listener's ear. Thirdly, since the sound generating element is a section of the case, a separate loudspeaker diaphragm does not need to be provided, thus reducing the parts-count of the device.

All portable electronic devices include a case of some sort. The case is typically a plastic molding, forming a thin, lightweight robust cover for the device. In the speaker of the invention, an area-extensive section of the case is separated from the rest of the case, as though cut out from the case, to act as the sound generating element of the speaker. This element may be any suitable shape. For instance it may be circular, square or rectangular or an irregular shape, but preferably it is shaped to follow the contours of the case of the device. The sound generating element may form a continuous surface or it may include holes or spaces, through which protrude other elements of the device, such as the display, keypads, camera etc. The sound generating element may be flat, but preferably it is curved or domed to improve its stiffness. The sound generating element may indeed be manufactured by cutting from the molded case, but preferably it is a separately manufactured element shaped to fit a suitable opening in the case. In the latter case, the material and design of the element may be optimized, for instance in terms of mass and stiffness, for operation as a sound generation element.

The gap between the edges of the sound generating element and the rest of the case may be sealed by a flexible seal or suspension element as in a conventional loudspeaker. Such a seal element serves the purpose of preventing rear-radiated sound from interfering with the forward-radiated sound, and additionally prevents ingress of dirt. However, in a preferred embodiment of the invention, no such seal is provided. The gap is instead engineered to be very small at all points, less than 2 mm and more preferably less than 0.5 mm. With such a small gap, sound interference is negligible and dirt ingress is minimal. A loudspeaker without a seal is novel and inventive in itself.

In a second aspect of the invention therefore, there is a provided a loudspeaker including a mount, an actuator and a sound generating element wherein the gap between the sound generating element and the mount is at all points less than 2 mm and there is no sealing or suspension element in the gap.

In a preferred embodiment of the second aspect of the invention, a perpendicular (or near perpendicular) lip is provided along and around the edges of the sound generating element, the lip protruding inwards into the device from the edges of the sound generating element. The length of the lip is of the same order as or longer than the maximum displacement of the element during operation such that it acts as a sound baffle, providing significant acoustic resistance and thereby further reducing interference from rear-radiated sound. In a further preferred embodiment, a corresponding adjacent lip is provided around the enclosing edge of the mount, providing yet greater acoustic resistance.

The sound generating element according to the first aspect of the invention is a section of the case, that is, it is on the external surface of the device. As an alternative, any area extensive element within the device may be used as the sound generating element of the loudspeaker. For example, in a mobile phone, internal area extensive elements include printed circuit boards, the battery, the battery housing and the key pad. Any of these may be connected to an electro-active actuator to provide a loudspeaker. The benefit is that a separate loudspeaker diaphragm need not be provided, resulting in space savings. To allow the sound to be heard externally, suitable ports or holes are provided in the case, as is normal with conventional mobile phone loudspeakers. The use of an existing internal element as a sound emitting element is itself novel and inventive.

In a third aspect of the invention therefore, there is provided a loudspeaker for a possibly portable electronic device wherein an internal area extensive functional component of the portable electronic device is the sound generating element of the loudspeaker.

The sound generating element of the loudspeaker is coupled to an electro-active actuator. Electro-active materials are those which change shape in response to an electric field (or conversely, generate an electric field when mechanically activated). Electro-active materials include piezoelectric materials, which expand or contract when electrically activated, and electrostrictive materials which contract in an electric field. Examples are piezoelectric ceramics such as PZT (lead zirconate titanate), piezoelectric polymers such as PVDF (polyvinylidene fluride) and electrostrictive ceramics such as PMNT. The basic electro-active effect is very small, typical displacements being no more than a fraction of a micron for a centimeter sized block of electro-active material when electrically activated. Accordingly, the actuator of the loudspeaker of the invention is not a simple block of electro-active material but is an arrangement of electro-active and electrode materials capable of at least 10 microns of movement.

The electro-active actuator may be of a known construction, such as a piezoelectric actuator stack or one or more benders. Preferably however the actuator is of the type known as a "Helimorph" (™) actuator, as described for instance in the published International Patent applications WO-01/47041 (PCT/GB00/04949) and WO-01/47318 (PCT/GB00/04953) or of the stacked-recurve-bender type described for use in loudspeakers in our co-pending British patent application No. 0114655.4, which is incorporated herein by reference. Such actuators provide displacements of the order of 100 microns or more from a compact device with dimensions of the order of 20 mm or less (usually at least one dimension is only a few millimeters). Other actuators may be used, as described below when making reference to hinged sound emitting element.

One end of the electro-active actuator is coupled to the sound generating element while the other end is mounted such that when activated by an electrical signal, the two ends of the actuator are displaced relative to each other. Since the sound generating element is more free to move than the mounting, activation causes the sound generating element to move preferentially. In particular, activation with an audio signal causes vibration of the sound generating element, producing sound.

The actuator may be located in the approximate centre of the sound generating element as in a conventional loudspeaker. In conventional loudspeakers, the actuator is usually a voice-coil electromagnetic actuator. Such actuators are very sensitive to off-axis movements, since the gap in the magnet along which the electrical coil moves to and fro is necessarily small to allow maintenance of sufficient magnetic field strength. However, the electro-active actuators of the present invention are not so constrained to move accurately axially, such that it is possible to locate the actuator off-centre. This is of benefit where the loudspeaker is used in a device where space is constrained, as is typically the case for portable electronic devices such as mobile telephones, lap-top computers and PDAs, as the actuator may by located in any convenient position rather than only at the centre. While off-centre actuators are known for loudspeakers in which the sound generating element operates in surface wave mode (also known as "distributed mode" speaker), the use of off-centre actuators in loudspeakers in which the sound generating element operates in pistonic mode is novel and inventive in itself.

In a fourth aspect of the invention therefore, there is provided a loudspeaker operating in pistonic mode in which the actuator is not located centrally with respect to the sound generating element.

As described above, the loudspeaker in accordance with the first aspect of the invention includes a single actuator. Whilst this forms one preferred embodiment of the invention, an alternative embodiment includes instead two or more actuators. This is of advantage as the load may be distributed between the actuators, which therefore need not be so powerful individually. Further, the relatively large area of sound generating element is driven in more than one place, allowing it to be made to a less stiff design or from a less stiff material, providing weight savings. Additionally, the use of more than one actuator provides improved balance and stability. The several actuators may for instance be two actuators, one at, or towards, each end of the sound generating element, or four actuators at the corners of a rectangular sound generating element, or whatever number and location of actuators is suitable. The use of several actuators to drive a single sound emitting element operating pistonically is itself novel and inventive.

Accordingly, in an fifth aspect of the invention, there is provided a loudspeaker in which the single sound emitting element is driven by a plurality of actuators.

A loudspeaker according to the fifth aspect of the invention is advantageous for use in electronic devices as described above. However, it is also of benefit for other loudspeakers in other applications. For example, in one embodiment of the this aspect of the invention, a low frequency loudspeaker, commonly known as a woofer, bass-woofer or sub-woofer, is provided, comprising a large area panel driven by a plurality of actuators. Preferably the panel has dimensions of the order of a meter by a meter, the actuators are electro-active actuators of the Helimorph type and are arrayed on the rear of the panel. The actuators are coupled at one of their ends to the rear of the panel and at their other ends to a relatively immovable mount. The more actuators that are provided, the less powerful each actuator needs to be to provide high SPL. Accordingly, there are preferably more than 4 actuators and there may be as many as 10 or more actuators.

In a further embodiment of the invention, the sound generating element is pivoted or hinged or mounted via flexures (hereinafter collectively referred to as hinged) at one or more points and actuated at one or more points. The movement of the sound emitting element is then not purely pistonic, that is, in operation, not all points on the surface of the sound emitting element move the same distance. The benefit of the hinged arrangement is that the actuator may then be located and mounted beyond the area directly beneath the sound emitting element, because a balanced drive is not necessary. In addition, the hinge provides non-axial stability without unwanted stiffness or resistance in the driven direction.

The simplest embodiment of the hinged sound emitting element is a sound emitting element hinged at one end and actuated at the other. In accordance with the first aspect of the invention, the sound emitting element is an area extensive section of the case. In the present embodiment, a simple hinge, such as a bead of elastomeric material or a flexure, connects the case to the sound emitting element at one end. At the other end of the sound emitting element, the electro-active actuator is connected at one of its ends to the sound emitting element and at its other end to a mount, which is preferably the inner surface of the case. In operation, the actuator moves the end of the sound emitting element to which it is connected, while the other end of the sound emitting element close to the hinge moves hardly at all. The motion is rather like that of a hand fan, the swept volume being an angular segment of a cylinder. This motion includes an element of rotation about an axis parallel to the sound emitting element. In a further embodiment, two or more hinges are provided spaced from each other along the line of the edge of the sound emitting element, providing improved lateral stability. Indeed, the concept of a loudspeaker in which the sound emitting element is hinged is novel and inventive in itself.

In a sixth aspect of the invention therefore, there is provided a loudspeaker wherein the motion of the sound emitting element to generate sound includes rotation about an axis parallel to the diaphragm.

In one preferred embodiment of the sixth aspect of the invention, the diaphragm is supported at one or more points by a hinge, pivot or flexure.

In a further preferred embodiment of the invention, the hinge is incorporated in the sound emitting element as an integral hinge. For instance, where the sound emitting element is a plastic sheet of a given thickness, one or more thinner areas may be provided to act as hinges. In assembly, the sound emitting element is mounted on one side of the hinge so that in operation the material on the other side of the hinge acts as the sound generating element. Such a sound emitting element is easy to manufacture for instance by injection molding.

A yet further preferred embodiment of the sixth aspect of the invention relates to a loudspeaker for use in a portable electronic device such as a mobile phone, in which the hinged sound emitting element is transparent and covers the screen, or the screen and some of the area of case surrounding it. The benefit of this arrangement is that a large area sound emitting element can be provided, producing high SPL at low frequency, without obstructing the screen. The hinged sound emitting element is of particular advantage in this case as the actuator is at the periphery of the sound emitting element, not in the centre where the screen is located.

In further preferred embodiments of the sixth aspect of the invention, a hinged loudspeaker sound emitting element is provided inside an electronic device such as a computer, a mobile phone, a lap-top or a PDA. The sound emitting element is area-extensive and may rest just below the case of the device, which case includes ports for sound emission over the area of the sound emitting element. Alternatively, the hinged sound emitting element may be further to the inside of the device, with ports in selected areas of the case to direct sound in particular directions.

Further, there may be more than one hinged sound emitting element in such a device. For example, there may be two, one at each end of the device, separated by a baffle and with ports in the case at the corresponding each end of the device to emit two separate sounds. It is thereby possible to produce stereo sound. It is further possible, by electronically applying a Head Related Transfer Function (HRTF) to the input signal, to generate psychoacoustic surround sound. This may be of particular advantage for instance for viewing films on lap-tops and PDAs.

Advantageously, by locating the actuator in the vicinity of the hinge section or by replacing the hinge section, only a small actuator displacement is required to cause a large displacement at the distal end of the sound emitting element. Thus, the dimensions of the actuator can be reduced in line with the reduced displacement resulting in smaller design compared to previous devices.

For this embodiment of the sixth aspect of the invention, the actuator is preferably formed having a cylindrical shape with one sector extending along the longitudinal axis of the cylinder being removed. This actuator has a c-shaped cross-section with one end mounted onto the support structure and the other exerting force onto the edge of the sound emitting element that is closest to the hinge.

In the above embodiments of a hinged sound generating element, the actuator is placed close to either its proximate or its distal end. However arbitrary contacts point between the sound generating element and the actuator or levered extension thereof may be chosen along the length and width of the sound generation element, provided such sound generating element has sufficient degree of stiffness to transmit the force and hence the movement from the point of contact to its other parts.

In a seventh aspect of the invention, the above device comprising of sound generating element, a hinge section and electro-active actuator is mounted on a frame element. The frame element in turn is flexibly mounted on the support. As above, the support can be a part of the case or outer shell of the portable device or an inner part thereof.

According to this aspect of the invention, the flexibly mounted frame and the loudspeaker device together form an oscillating element. This results effectively in a system that can be regarded as a vibrating or oscillating system with two degrees of freedom. Such a system can be modeled as a system of two masses and two springs having two fundamental resonance frequencies. In this example, the sound emitting element is one mass and the actuator and the acoustic impedance together form the associated spring. The combined mass of sound emitting element, actuator and frame is the mass of the second oscillator. The second spring is the flexible mounting of the frame.

The resonance frequency or frequencies of this element can be tuned in various ways known to a skilled person. For example, varying the stiffness of the element that provides the flexible connection between the support and the frame changes the resonance frequency. Or, the combined mass of the frame and loudspeaker system mounted on the frame may be modified to tune the resonance frequency. By thus choosing a resonance frequency of the flexible mounted frame of below 200 Hz, preferably below 150 Hz, and even more preferably below 100 Hz, the flexible mounted frame can be excited through an external drive to oscillate or vibrate in a frequency range that does not generate a significant acoustic output from the loudspeaker system. While in principle the excitation or driving force could be provided by a further actuator mounted between support and frame, in a preferred embodiment this force is generated by the electro-active actuator that drives the sound element. Thus, the system is preferably designed such that the frame does not move significantly in the frequency range in which the loudspeaker generates significant audio output.

In this embodiment the resonance frequency is tuned such that at audio frequencies, i.e., above 200 Hz, the mechanical impedance, stiffness or inertia of the system is sufficiently large to impede movement of the frame relative to the support.

These and other features of the inventions will be apparent from the following detailed description of non-limitative examples making reference to the following drawings, throughout which like parts are designated by like reference numerals and characters.

BRIEF DESCRIPTION OF THE DRAWINGS

In the drawings:

FIG. 6 is a cross-section through a loudspeaker in which the diaphragm is hinged;

FIG. 7 illustrates the operation of the loudspeaker of FIG. 6;

DETAILED DESCRIPTION

Figure 1A:
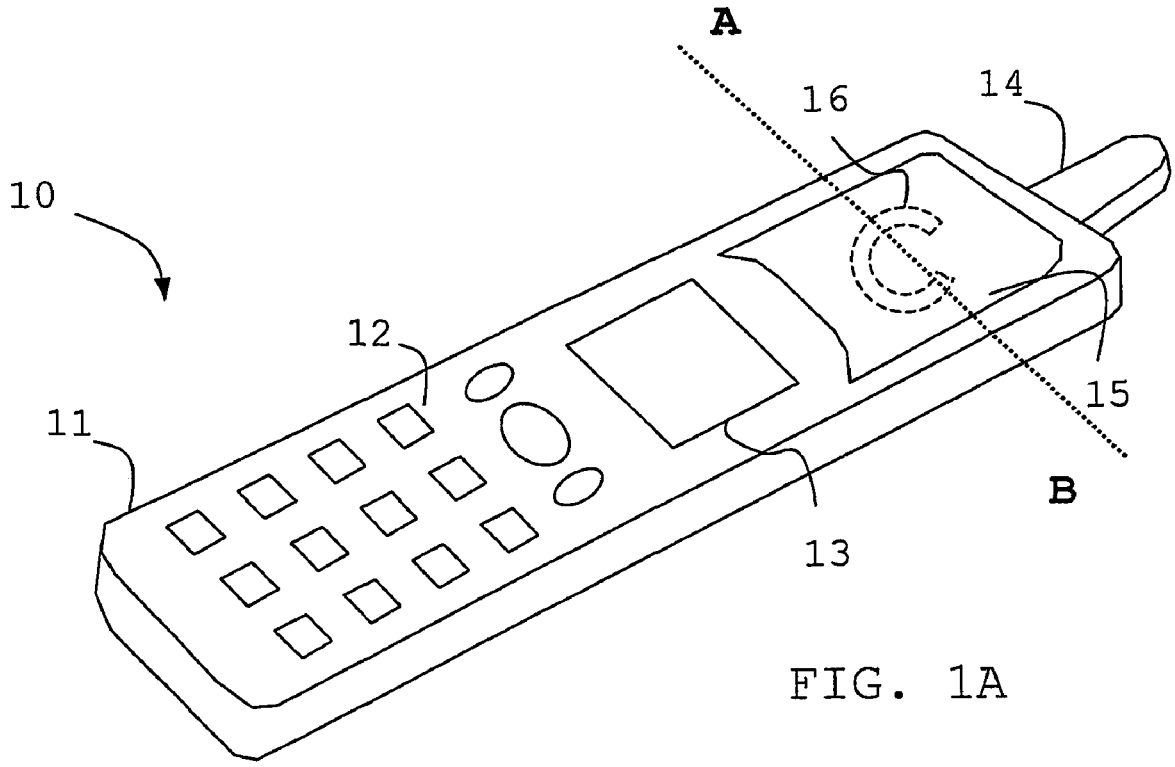
FIG. 1A shows a mobile phone incorporating a loudspeaker diaphragm which is part of the case.

In FIG. 1A, there is shown a mobile phone handset 10. The mobile phone 10 includes the known features of case 11, touch sensitive keypad are aerial 14. The loudspeaker system comprises an area extensive section 15 of the case, which acts as the sound generating element or diaphragm, driven by a piezoelectric actuator 16 beneath it.

The actuator 16 is preferably of the type known as a Helimorph (™) actuator, as described in the patent applications referenced above.

Figure 1B:
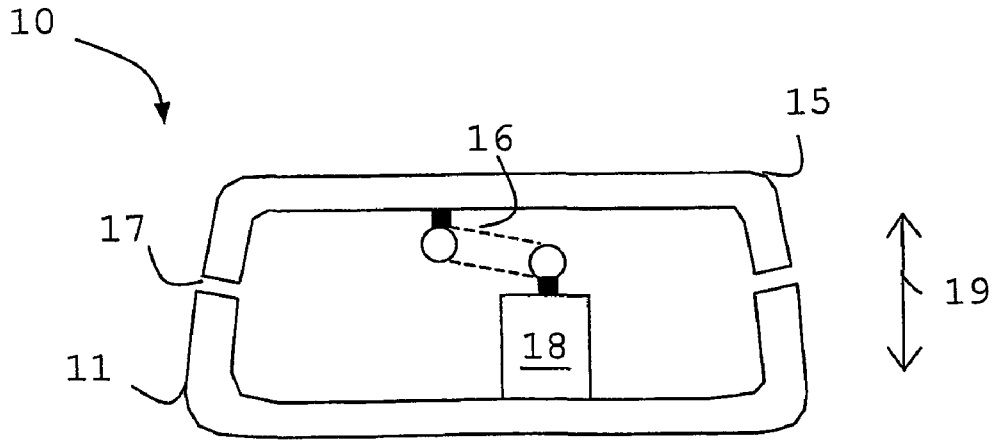
FIG. 1B shows a cross section through the loudspeaker of FIG. 1A.

A schematic cross-section through the mobile phone 10 of FIG. 1A along the line AB is shown in FIG. 1B. The sound generating element 15 is shown at the top of the figure, abutting the case 11 with a small gap 17 between them. The Helimorph actuator 16 is connected at one end to the underside of the diaphragm 15 and at its other end to a support 18 which is mounted in the case 11 of the mobile phone 10. The actuator 16 is connected to an electrical circuit (not shown), which provides electrical oscillations at audio frequencies. The electrical fields generated between the electrodes of the Helimorph device 16 cause it to expand or contract in the direction of the double-headed arrow 19, causing the diaphragm 15 to vibrate at audio frequencies, generating sound.

Figure 2:
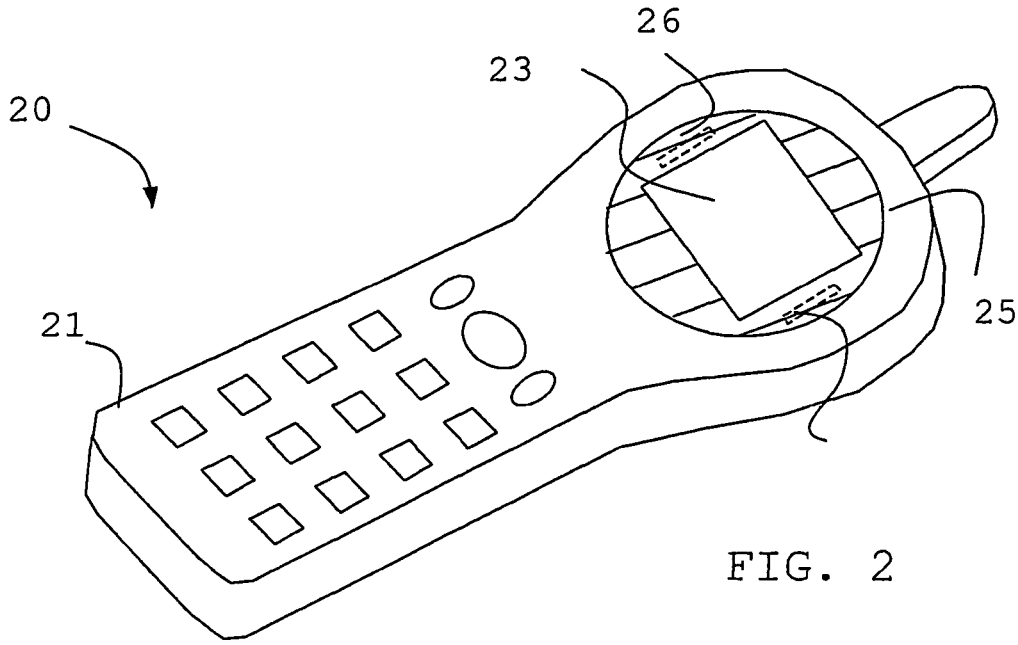
FIG. 2 shows an alternative arrangement of a loudspeaker diaphragm which is part of the case.

An alternative embodiment of the loudspeaker of the invention in a mobile phone 20 is shown in FIG. 2. In this case, the sound generating element 25 (hatched) is roughly circular with a rectangular shaped hole through which the screen 23 protrudes. The sound generating element is flush with the case 21 and is driven by a pair of stacked recurve bender piezoelectric actuators 26 situated beneath the diaphragm 25 on either side of the screen 23.

Figure 3:
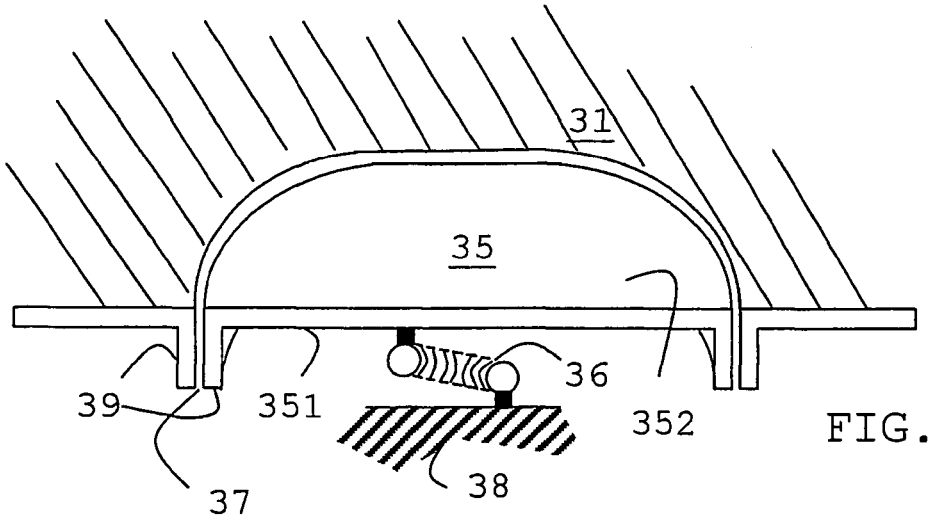
FIG. 3 shows a loudspeaker in which a lip around the diaphragm forms a sound baffle.

In FIG. 3, a cut-away view through an embodiment of the invention is shown in which the edge of the diaphragm 35 and the adjacent edge of the case 31 incorporate a lip 39 to act as an additional acoustic resistance. The diaphragm 35 rests in a hole in the case 31 with a small gap 37 between. As before, the diaphragm 35 is driven by a Helimorph actuator 36 connected to a mounting 38 at one end. Perpendicular lips 39 extend around the outer edge of the diaphragm 35 and the adjacent edge of the case 31 such that as the diaphragm 35 moves up and down in operation, the gap 37 between the case 31 and the diaphragm 35 remains very small. The lips serve to help prevent rear-radiation of sound from the underside 351 of the diaphragm 35 from interfering with the forward radiated sound from the upper side 352 of the diaphragm 35. Even when the lip 39 on the case 31 is of shorter length (or not present), the lip 39 on the diaphragm 35 maintains a narrow gap 37 and thus a high acoustic resistance.

Figure 4:
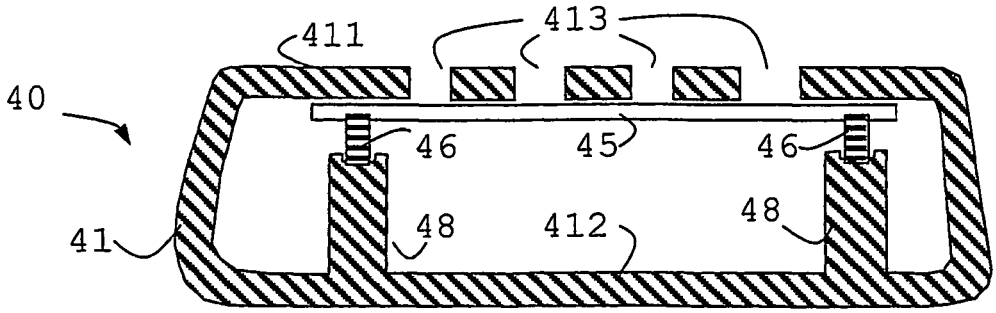
FIG. 4 shows a loudspeaker in which the diaphragm is a PCB inside a mobile phone.

In FIG. 4, a printed circuit board (PCB) 45 acts as the diaphragm of the loudspeaker. The printed circuit board 45 is an internal functional element of the mobile phone 40 of which FIG. 4 shows a cross-section. The board is connected to two stacked recurve bender actuators 46 on a mounting 48 located on the underside of the case 41. The actuators 46 expand and contract on electrical activation, moving the PCB up and down to generate sound. A number of ports 413 are provided on one side 411 of the case 41 in the area adjacent to the sound generating element 45 to allow the sound to escape. No ports are provided on the other side 412 of the case, such that emission of rear-radiated sound is minimized.

In FIG. 5, there are illustrated in plan view from above a number of possible arrangements of actuators 56 in the loudspeaker of the invention. Helimorph actuators 56 are illustrated but other piezoelectric actuators can also be used. In FIG. 5A the loudspeaker diaphragm 55 separated from the case 51 (hatched) by a small gap 57. The Helimorph actuator 56 is shown beneath the diaphragm 55 in an off-centre position. This can be of advantage when there are other components underneath the dead-centre of the diaphragm 55. In FIG. 5B, there is shown a further embodiment in which the diaphragm 55 is driven by two Helimorph actuators 56 positioned one at each end. A further embodiment is shown in FIG. 5C incorporating four Helimorph actuators 56, one at each corner of the diaphragm 55. In FIG. 5D, the loudspeaker device of the invention has a circular diaphragm 55. The diaphragm 55 is hinged at one end with a blob of silicone rubber 59 and driven by a Helimorph actuator 56 at the other end. The actuator 56 lies beneath the case 51 and the diaphragm 55, and is connected at one end 561 to the inside of the case 51 and at the other end 562 to the underside of the diaphragm 55.

Figure 5A:
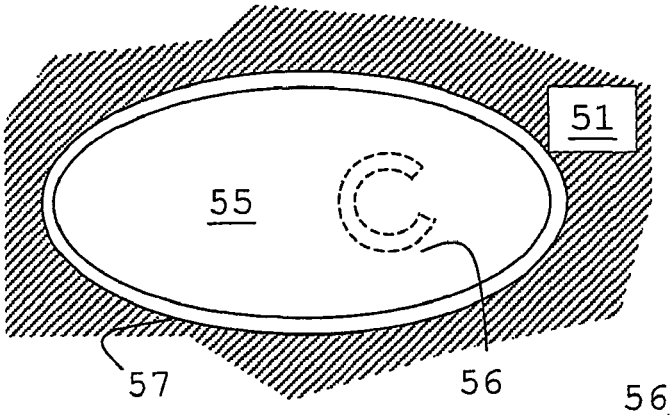
FIG. 5 shows some alternative positions for the loudspeaker actuators.
Figure 5B:
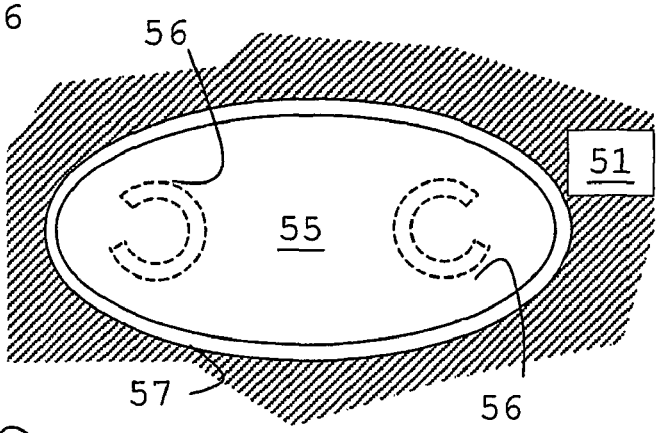
Figure 5C:
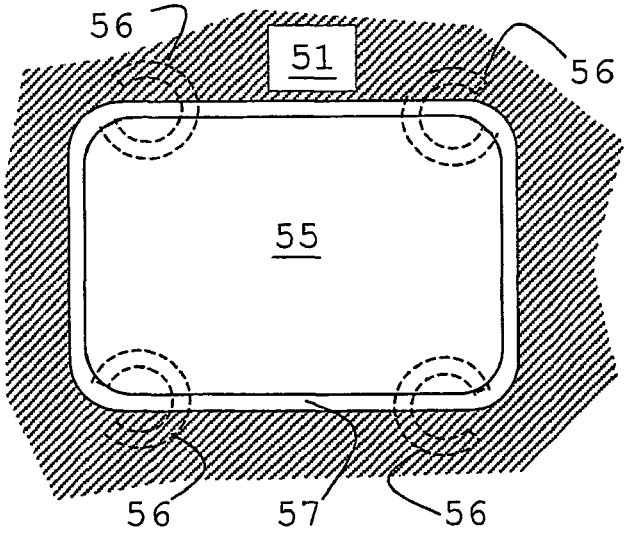
Figure 5D:
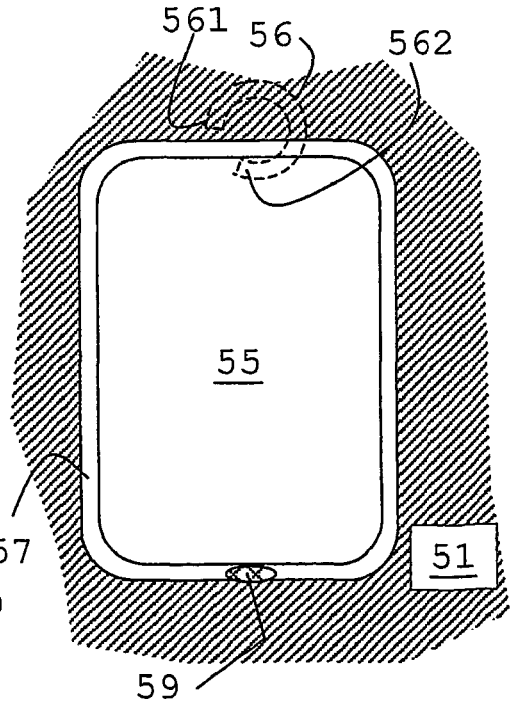

The operation of the hinged diaphragm device of FIG. 5D is illustrated further in FIG. 6. The diaphragm 65 is hinged at hinge 69, which hinge is mounted on the case 61 and occupies the gap 67 between the diaphragm 65 and the case 61 at one point on the circumference of the diaphragm 65. At the opposite point on the periphery of the diaphragm 65, the diaphragm 65 is driven by a Helimorph actuator 66 connected at one of its ends 661 to the diaphragm 65 and at its other end 662 to the case 61. This is a particularly compact form of loudspeaker since the Helimorph device 66 is very thin, typically no more than 2 mm in thickness, and protrudes little into the interior of the mobile device.

In FIGS. 7A, B, and C the motion of the diaphragm 75 on activation is shown schematically. FIGS. 7A, B, and C show the case 71, hinge 79, diaphragm 75, actuator 76 and couplings 761 and 762, as in FIG. 6. In FIG. 7A the actuator 76 is in its unactivated position and the diaphragm 75 lies flush with the case 71. In FIG. 7B the actuator 76 is in its extended position and the diaphragm 75 is lifted at that end, rotating about the hinge 79. The unactivated position of the diaphragm 75 is shown by the dotted line. In FIG. 7C the actuator 76 is in its contracted position and the diaphragm 75 is lowered at that end with respect to the case 71. As before, the unactivated position of the diaphragm 75 is shown as a dotted line. In the positions of FIGS. 7B and 7C, it can be seen that the diaphragm has moved through an angles alpha 1 and alpha 2 (greatly exaggerated for clarity) with respect to its unactivated position, constituting a rotation about an axis out of the plane of the paper running through the hinge 79, which axis is parallel to the plane of the diaphragm 75.

Figure 8A:
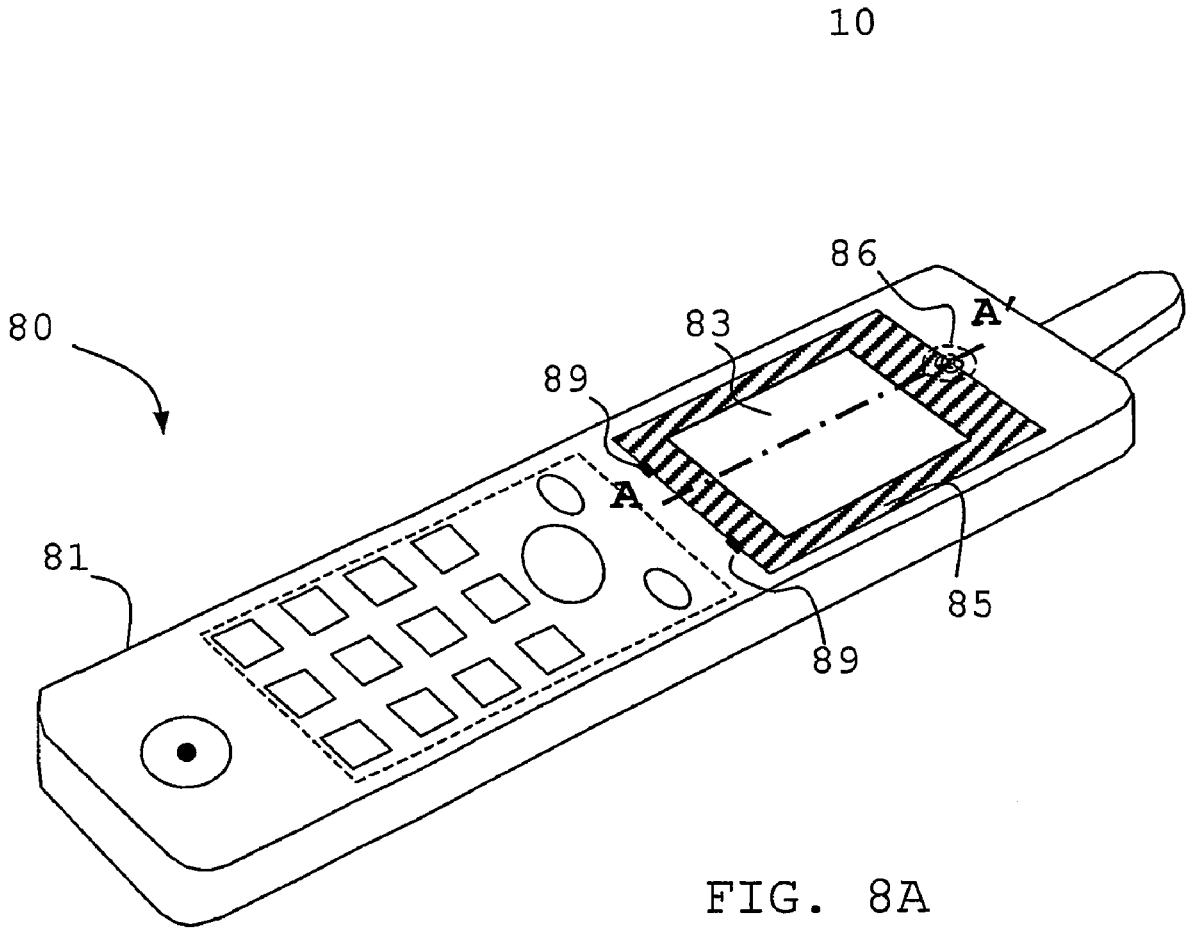
FIG. 8A shows a mobile device in which the loudspeaker is hinged.
Figure 8B:
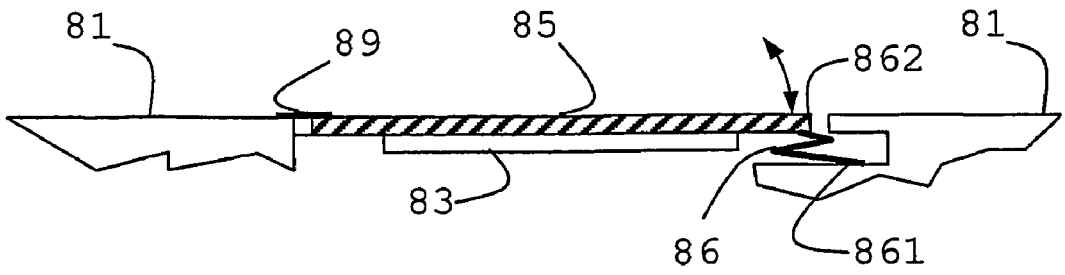
FIG. 8B shows a cross-sectional view of the FIG. 1A taken along line A-A'.

The FIGS. 8A and 8B, which is a cross-section of FIG. 8A along line A-A', show the loudspeaker of FIGS. 5-7 incorporated into a mobile phone 80. The diaphragm 85 (hatched) is transparent and lies over the screen 83. It is shown hinged at two points 89. It is driven by a Helimorph actuator 86 fixed at one end 861 to the case 81 and at the other end 862 to the diaphragm 85. The area of the diaphragm 85 is approximately 40 mm by 50 mm. The two hinges 89 are silicone rubber and are spaced 18 mm apart. The Helimorph actuator 86 is a multilayer PZT helix curved into about three-quarters of an arc of a circle. The multilayer PZT has a bimorph bender construction, with two layers of PZT each 0.3 mm thick, with conventional electrodes on the outer surfaces and between the two layers (not shown). The tape width is 2 mm and the helix diameter is 5 mm. The helix is curved into an arc of a circle of 18 mm diameter. The loudspeaker therefore occupies a space within the mobile phone of only 18 mm diameter and 5 mm thickness. The mass of the actuator 86 is about 2.5 g and that of the diaphragm 85 about 0.3 g. On maximum activation, the tip displacement is +/−200 microns. When an audio signal is inputted to the actuator 86, Sound Pressure Level (SPL) of about 70 dB at a distance of 30 cm is achieved over the frequency range 100 Hz to over 10 kHz.

As mentioned above, the Helimorph actuator 86 has been chosen as the basic electro-active effect is very small with typical displacements being no more than a fraction of a micron for a centimeter sized block of electro-active material when electrically activated. However, it was found that other types of electro-active actuators could be successfully employed within the scope of the present invention.

Figure 9A:
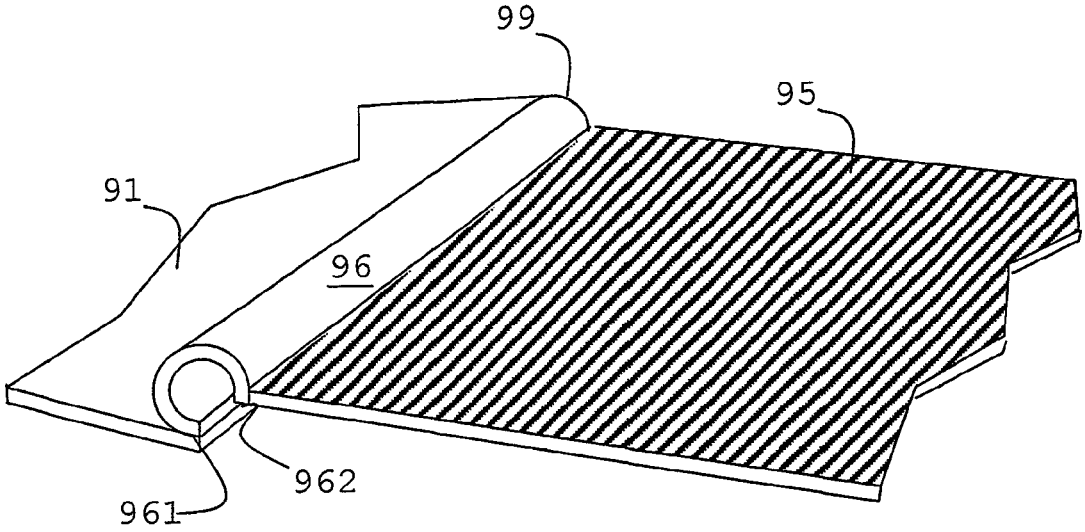
FIG. 9A is a perspective view of an example of a hinged sound generating element having a hinge section that include piezoelectric material.

For this purpose, the hinge section of the following example in accordance with the invention is modified to include electro-active material. Referring to FIG. 9A, there is shown a basic perspective view of a hinge section similar to the one of FIG. 8A. It shows a section of the case 91 and the diaphragm 95 in vicinity of the hinge section. In the example, the hinge section 99 comprises a tubular element 96 of electro-active material. A 90-degree section of the tubular element 96 parallel to its main axis is removed giving the element 96 an approximately C shaped cross-section. The element 96 acts as an actuator. The case 91 is fixed to a first edge 961 of the tubular element 96, whereas the sound generating element or diaphragm 95 is attached to a second edge 962 of the tubular element 96.

Figure 9B:
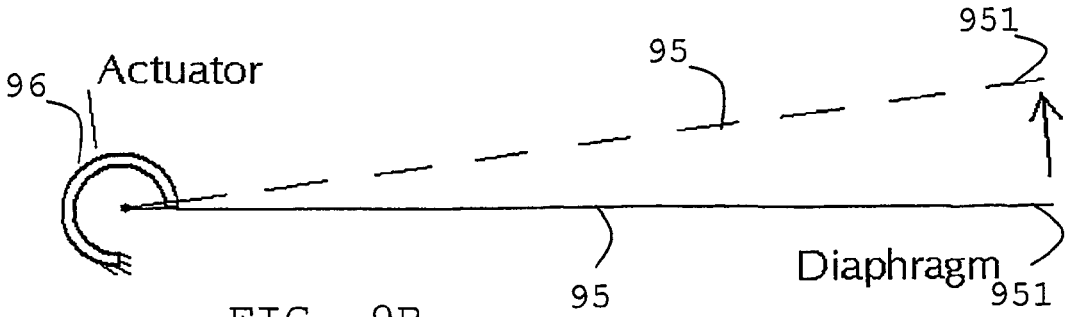
FIG. 9B is a cross-sectional view of the device of FIG. 9A.

The electro-active tubular element 96 is 25 mm long, with an outer diameter of 4.4 mm and a tape thickness of 0.4 mm. When energized, it is capable of generating an angular movement around it main axis of ±0.33 degrees with a blocking torque of 3.2 mNm. This translates to a displacement of the distal moving end 951 of the diaphragm 95 of ±0.26 mm, as illustrated by FIG. 9B. The equivalent force at this edge is about 0.071 N. This compares with the above-described Helimorph driven loudspeaker system, which has a displacement of ±0.2 mm and a blocking force of 0.068 N. The electro-active tubular element 96 and other examples of electro-active rotators suitable for the purpose of this invention are described in more detail in WO-02/17408, incorporated herein by reference.

The mass of the actuator 96 is 0.75 g, and the current mass of the diaphragm 95 is 0.2 g. However, since the actuator 96 is near the hinge, the inertia of the actuator 96 is 1.5 $gmm^2$ compared to the inertia of the diaphragm 95 of 166 $gmm^2$. So, whilst the mechanical performance of the actuator 96 is similar to the above-described Helimorph driven loudspeaker system, the inertia is negligible. Hence the actuator 96 is not using a large amount of its force to drive its own mass. It is being used to drive the diaphragm 95. The fundamental resonant frequency of the hinge-driven speaker of FIG. 9 is approximately 280 Hz, thus, enabling it to generate audible sound.

Figure 10A:
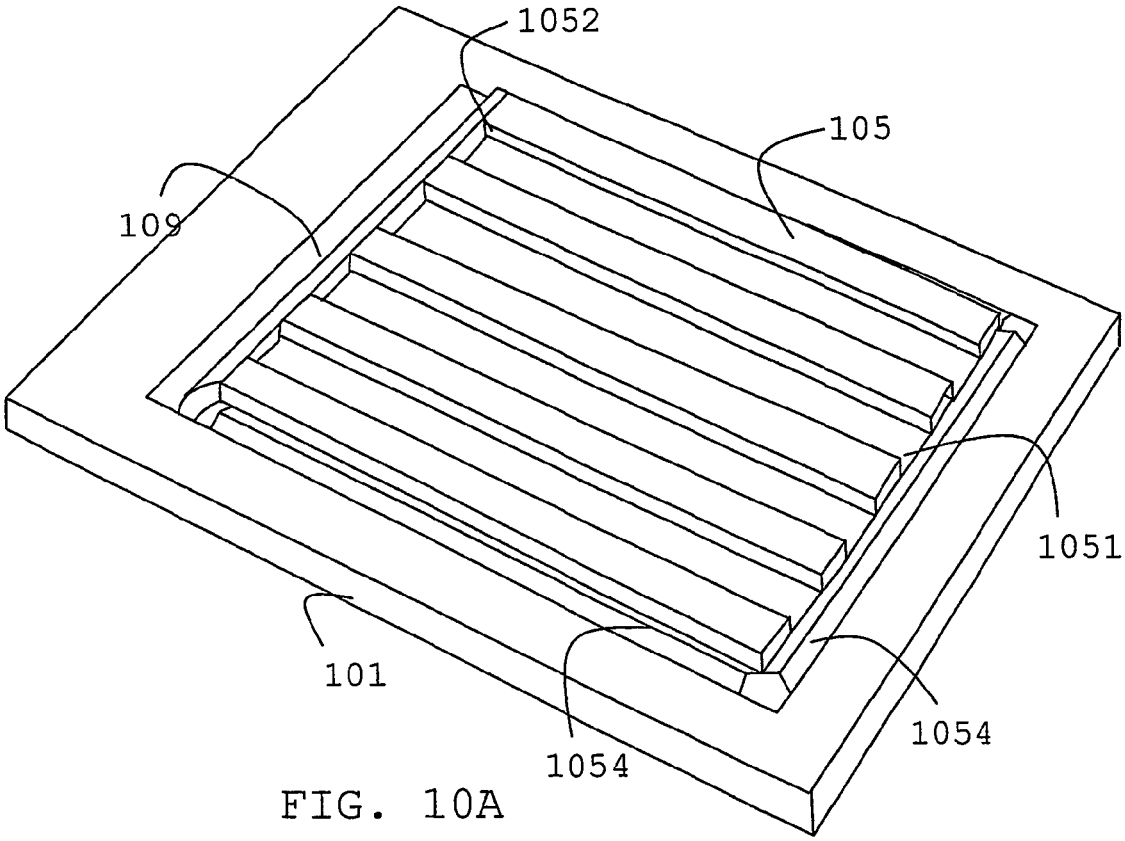
FIG. 10A is a perspective view of a second example in accordance with the invention.
Figure 10B:
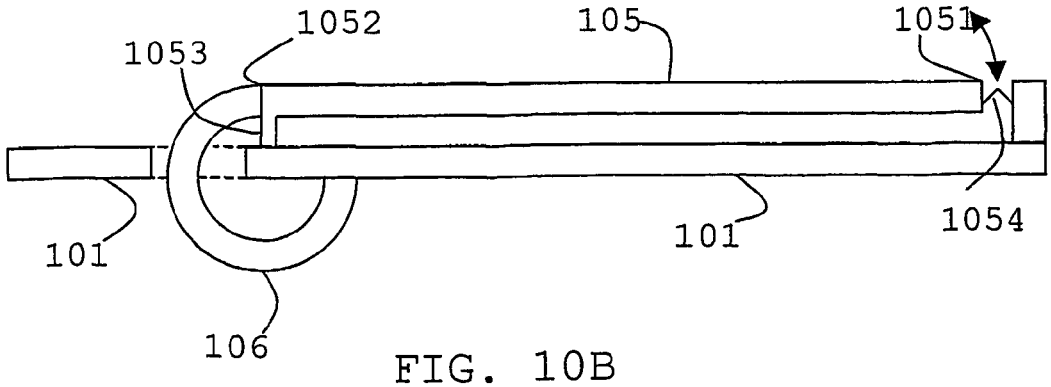
FIG. 10B is a cross-sectional view of the device of FIG. 10A.

In an alternative arrangement, shown in FIGS. 10A and 10B, a frame structure 101 supports a diaphragm or sound emitting element 105. The diaphragm 105 has distal end 1051 and a proximate end 1052. At the proximate end the diaphragm 105 is mounted to the support structure 101 by a hinge section 109 that allows a rotational motion of the diaphragm 105 around the axis of the hinge section.

The actuator 106, a C-shaped actuator as used in the above example, is mounted onto the back of the support structure 101 and extends through a slit in this structure to the proximate end of the diaphragm 105. It is adopted to exert its force predominantly in direction of the plane of the diaphragm 105, thereby rotating the diaphragm 105 around the axis of the hinge 109. A part of the diaphragm 105 and any members 1053 extending therefrom provide a small additional lever to further improve the force transfer from the actuator 106 to the diaphragm 105.

The diaphragm 105 is a made of polycarbonate, hot-pressed into a corrugated shape to enhance its rigidity whilst maintaining a low weight. Other materials displaying a low weight combined with high stiffness such as fiber-reinforced plastics are likely to be equally suitable for use in connection with the present invention. The diaphragm 105 may have a more complex internal structure including, for example, honeycomb reinforcements sandwiched between two layers of lightweight material and the like.

The diaphragm 105 has highly compliant edge sections 1054 to seal the half-space below or behind the diaphragm 105. In the present example the seals are formed by lips of thin polycarbonate and, hence, form an integral part of the diaphragm 105.

Figure 11:
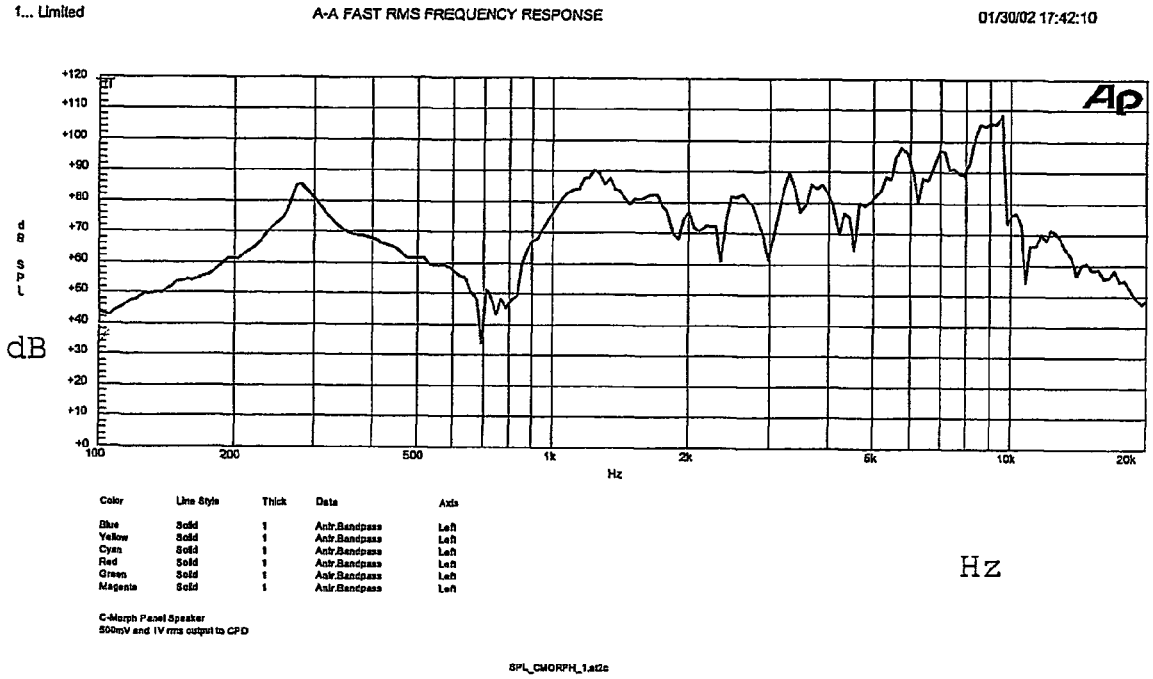
FIG. 11 is a plot of the rms frequency response of the example of FIG. 10.

The frequency response of the loudspeaker device is shown in FIG. 11. The sound pressure level SLP is given in decibel (dB) measured at 1 m distance from the diaphragm 105 in relation to the frequency in the range of 100 Hz to 20 kHz (in a logarithmic scale).

Figure 12A:
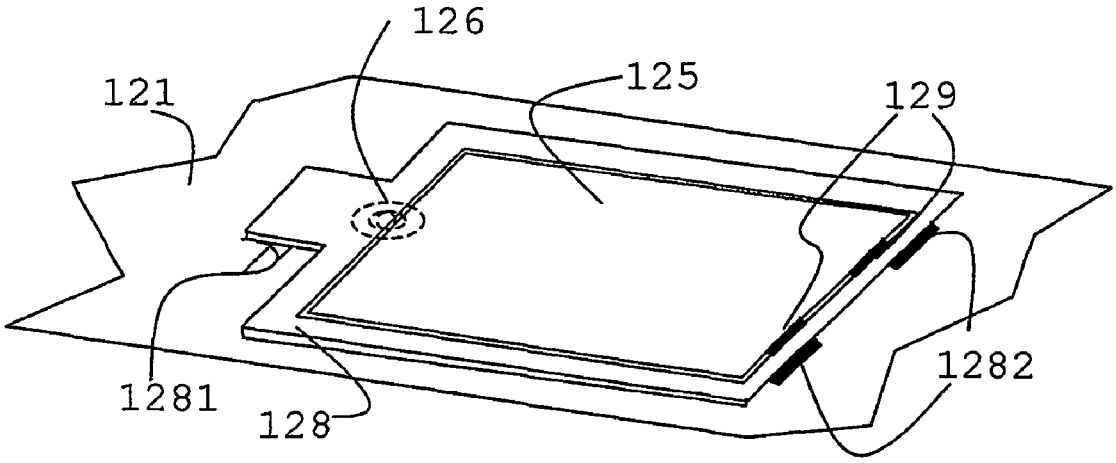
FIG. 12A is a perspective view of a further device in accordance with the present invention.
Figure 12B:
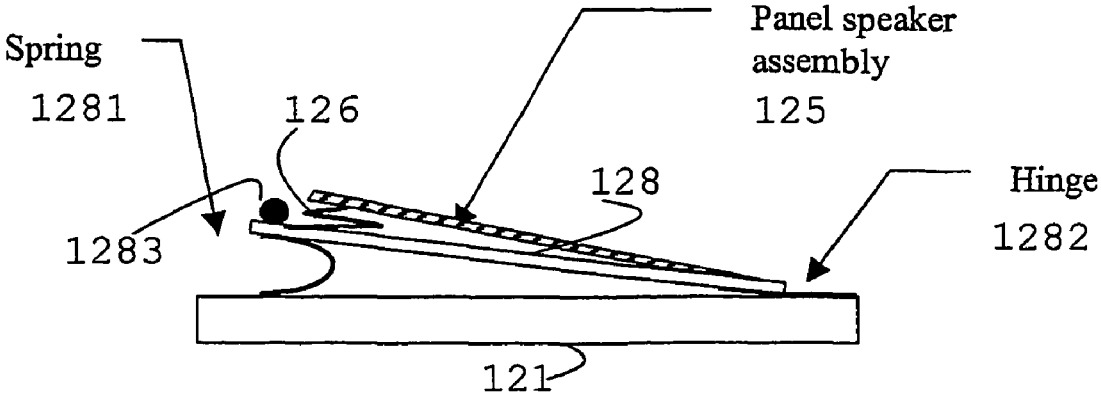
FIG. 12B is a side view of the device of FIG. 12A.

An embodiment capable of being used for generating audible sound and vibrations is shown with reference to FIGS. 12A and 12B. Again, there is shown a part view of a portable telephone having a case 121 and a loudspeaker system comprising a sound generating element or diaphragm 125 and an electro-active actuator 126 of the Helimorph type described above. However the device shown differ from previously described devices in that the hinge section 129 is not mounted on the case or shell 121 of the mobile device but on a frame structure 128. In turn, the frame structure is flexibly mounted by means of an elastic element 1281. In the example shown, the elastic element is a steel spring. At its distal end, the frame structure is fixed to the case 121 by a hinge-section 1282 similar to those described above.

The whole frame structure including spring and hinges form ideally an oscillating system with a single degree of freedom. This system is excited at is resonance by driving the actuator 126, with the resonant frequency being determined by the stiffness of the spring 1281 and its mass. The resonance is tailored such that at audio frequencies (i.e. above 200 Hz) the impedance of the system is large enough to impede movement of the panel relative to the base.

A first spring 1281 was formed by bending a piece of 25 μm spring steel around a 1 mm diameter wire former. The resonant frequency of this device was found by measuring its free vibration (in response to a manual displacement) with a laser displacement meter (LDM). The measured frequency was 60 Hz. By measuring the force/displacement characteristics of the spring the stiffness of the spring was found to be 216 $Nm^{-1}$. The dimensions of the original spring were as follows:

Length=5 mm
Width=4 mm
Height=3 mm
Angle=31° approx.

Knowing the resonant frequency of the system (60 Hz) and the spring stiffness, the apparent mass can be found:

$$\omega_n = \sqrt{\frac{k}{m_a}} \quad [1]$$

-continued $$m_a = \frac{k}{\omega_n^2} = \frac{216}{(2\pi(60))^2} = 0.00152 \text{ kg}$$

The actual mass of the system is given below:

Mass of actuator 126=0.552 g
Mass of Frame/diaphragm 125=1.541 g
Total mass=2.093 g
Apparent mass=1.520 g
Mass ratio=0.726

The mass ratio indicates that the centre of mass of the assembly is located approximately ¼ of the length of the diaphragm 125 from the end the actuator 126 is attached to.

In order to tune the frequency range of the device, the response of a vibrator component taken from a commercially available mobile phone was measured using the LDM and an accelerometer. This device consists of a small electric motor with an unbalanced weighted rotor, which produces a force when rotated. The response was measured for different voltages resulting in a target frequency range for the device of 75-80 Hz, hence slightly higher than the resonant frequency of the original device.

By referring to the dimensions and characteristics of the original spring, the required dimensions to achieve a resonance of around 80 Hz was estimated:

| | |
|---|---|
| Length = | 6 mm |
| Width = | 8 mm |
| Height = | 3 mm |

A spring was manufactured to these approximate dimensions and assembled into a device. The measured resonance frequency of 89 Hz was slightly higher than the target range. Thus, a small mass 1283 in the range of 0.1 g to 0.2 g was added to the frame as a location close to the actuator 126 (see FIG. 12B).

The resulting shift in the resonant frequency brought the device within the target range. A qualitative comparison of the magnitudes of vibration achieved by the original vibrator and combined device indicated that the original device created more vibration, although the combined device was within the same order of magnitude.

The performance of the combined device may be further improved by coupling it to a base plate that exhibits a resonant mode at the tuned frequency.

Figure 13A:
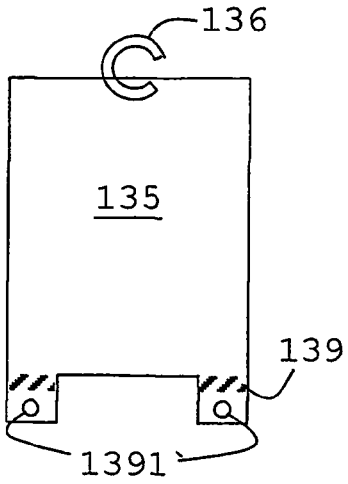
FIG. 13A is a perspective view of an example of a hinged sound generating element mounted onto a movable frame.
Figure 13B:
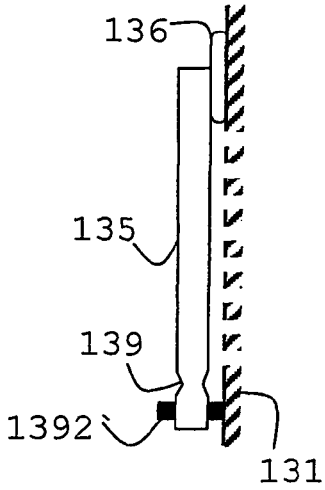
FIG. 13B further illustrates important elements of the device of FIG. 13A.

A schematic plane view (FIG. 13A) and cross-section (FIG. 13B) of a loudspeaker diaphragm 135 with integral hinges are shown in FIG. 13. The diaphragm 135 has two thinner areas 139 which act as hinges. Two mounting points 1391 are shown to one side of the hinges, with the sound generating area 135 being on the other side of the hinges. A Helimorph actuator 136 drives the sound generating element 135 at its end furthest from the hinges 139. An additional mounting pin 1392 is shown in FIG. 13B, located through the mounting point 1391. Both mounting pin 1392 and actuator 136 are mounted within the interior of the case 131. Holes in the case 131 provide a passage for sound between its interior to the exterior.

Figure 14:
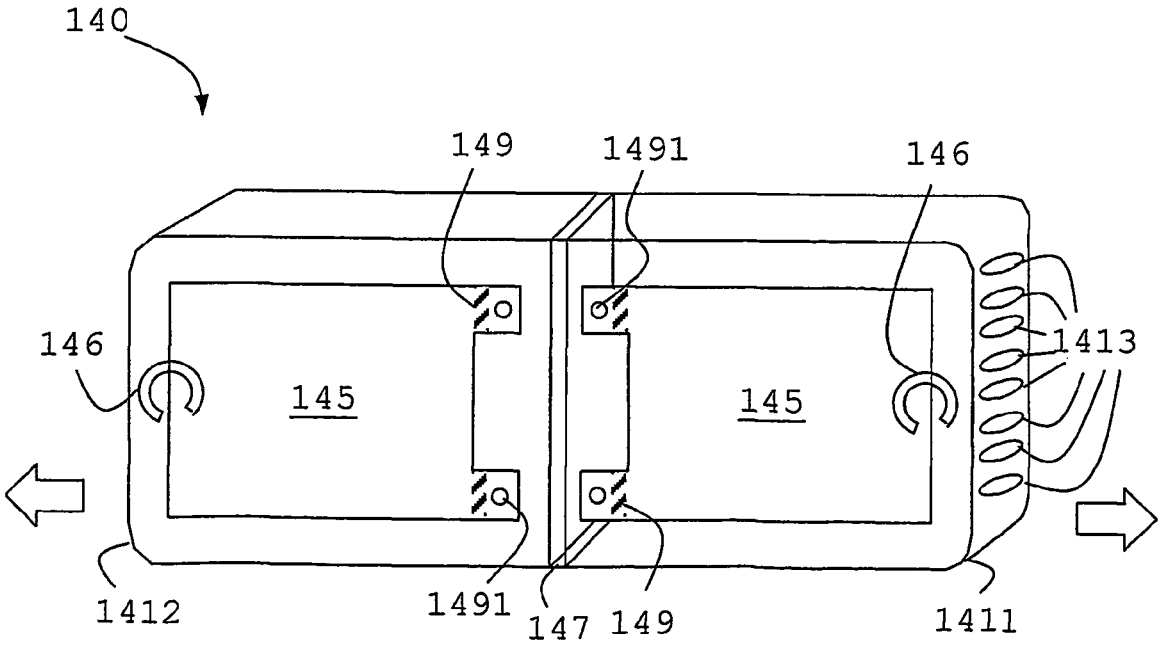
FIG. 14 is a perspective view of a mobile telephone with stereo loudspeakers having hinged diaphragms.

A mobile phone 140 with stereo loudspeakers incorporating hinged diaphragms 145 in shown in FIG. 14. For the purposes of illustration, the front face is not shown. The two speakers are similar, one located in each half of the mobile phone 140. Each speaker incorporates a diaphragm 145 and a Helimorph actuator 146. Each diaphragm 145 includes two thinner areas 149 to act as hinges, two mounting points 1491 and a sound generating area 145. On activation of the actuators 146, the sound generating elements 145 'flap' up and down, generating sound. Ports 1413 are provided at each end 1411, 1412 of the device to allow emission of sound, as indicated by the hollow arrows. A baffle 147 is provided half way along the length of the device to provide acoustic isolation of the two compartments in which the speakers lie. When two channels of stereo sound are inputted one to each actuator 146, two channels of sound are produced, one from each end 1411, 1412 of the device. The device illustrated in FIG. 14 is a mobile phone, but equally it could be a PDA, lap-top computer or screen compartment of these devices.

Figure 15:
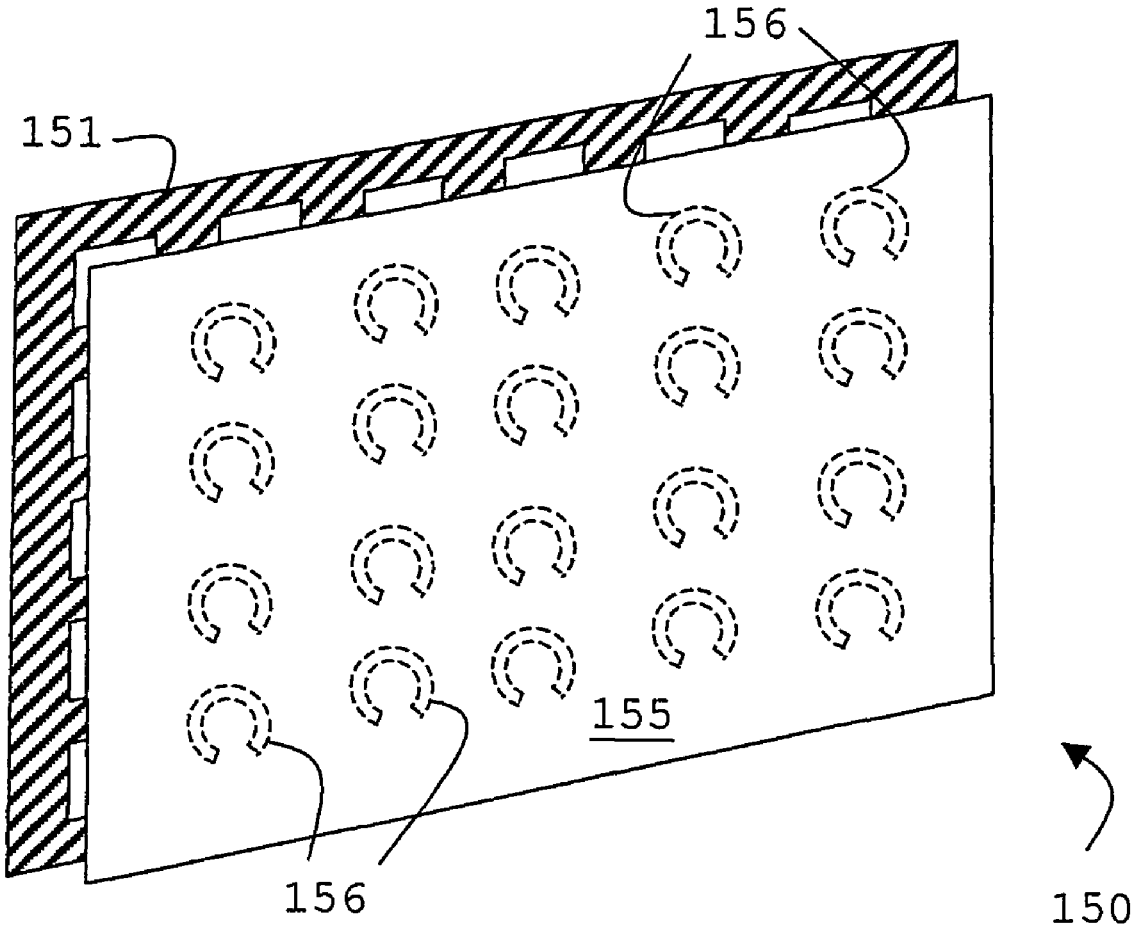
FIG. 15 is a perspective view of a bass loudspeakers having hinged diaphragms.

A bass loudspeaker with multiple electro-active actuators is shown in FIG. 15. The loudspeaker 150 comprises a frame 151 (hatched) on which are mounted 20 electroactive actuators 156 of the Helimorph type (shown with dashed lines) which actuators are coupled at their other (free) ends to a lightweight panel 155 which acts as the sound generating element. As is usual for a loudspeaker, a case (not shown) is provided behind the sound generating element to absorb rear-radiated sound. Alternatively a sound absorber (also not shown) may be mounted behind the panel to absorb rear-radiated sound. The height of the panel 155 is 44 cm and the width is 77 cm. Each actuators 156 is in the form of a helical bender curved into a circle, the helix diameter being 5 mm and the circle diameter 50 mm. The panel is an area extensive panel of lightweight material, such as a skinned polymeric foam, of a few millimeters thickness and a mass of around 200 g or less. On activation in parallel, the actuators cause the panel to move to and fro in a pistonic manner, with maximum displacements of +/−2 mm. The SPL available from such a speaker is 100 dB at a distance of 1 m from the panel at low frequencies down to 20 Hz. The loudspeaker illustrated thus forms a powerful bass woofer which is very compact and lightweight compared to conventional moving coil woofers.

Also, in British patent application No. 0115244.6 filed 21 Jun. 2001 entitled "LOUDSPEAKER" from which priority is claimed and which is incorporated herein by reference, there are described various devices and methods which embody the present invention.

The invention claimed is:

1. A loudspeaker for audible sound comprising a sound emitting element mounted onto a support structure and at least one actuator arranged to move said sound emitting element to generate sound, the actuator having a tubular shave with a removed sector and adapted to make a rotational movement between edges of the actuator formed by the removed sector when activated, the actuator being attached to the support structure and the sound emitting element by the respective edges and the motion of the sound emitting element including rotation.

2. The loudspeaker of claim 1, wherein gaps between the edges the sound emitting element and the support structure are bridged by one or more compliant seal members.

3. The loudspeaker of claim 1, wherein the actuator is a ceramic actuator.

4. The loudspeaker of claim 1, wherein the actuator is made of piezoelectric material.

5. The loudspeaker of claim 1, wherein the sound emitting element is transparent.

6. A portable electronic device comprising a loudspeaker for audible sound comprising a sound emitting element mounted onto a support structure and at least one actuator arranged to move said sound emitting element to generate sound, the actuator having a tubular shape with a removed sector and adapted to make a rotational movement between edges of the actuator formed by the removed sector when activated, the actuator being attached to the support structure and the sound emitting element by the respective edges and the motion of the sound emitting element including rotation.

* * * * *